US005526029A

United States Patent [19]

Larson et al.

[11] Patent Number: 5,526,029

[45] Date of Patent: Jun. 11, 1996

[54] METHOD AND APPARATUS FOR IMPROVING TRANSCRIPTION QUALITY IN ELECTROGRAPHICAL PRINTERS

[75] Inventors: Ove Larson, Vastra Frolunda; Lars Stråvik, Kungsbacka; Bengt Bern, Goteborg, all of Sweden

[73] Assignees: Array Printers AB, Moelndal, Sweden; Kyocera Corporation, Kyoto, Japan

[21] Appl. No.: 153,063

[22] Filed: Nov. 12, 1993

[30] Foreign Application Priority Data

Nov. 16, 1992 [SE] Sweden ..... 9203418

[51] Int. Cl.[6] ..... B41J 2/415

[52] U.S. Cl. ..... 347/55; 347/125

[58] Field of Search ..... 346/153.1, 154, 346/155, 159, 160.1; 347/55, 123, 125

[56] References Cited

U.S. PATENT DOCUMENTS

| | | | |
|---|---|---|---|
| 3,983,801 | 10/1976 | Watanabe et al. | 346/159 |
| 4,478,510 | 10/1984 | Fujii et al. | 346/159 X |
| 4,521,792 | 6/1985 | Clark et al. | 346/159 |
| 4,743,926 | 5/1988 | Schmidlin et al. | 346/159 |
| 4,833,492 | 5/1989 | Damouth | 346/159 |
| 4,903,049 | 2/1990 | Sotack | 346/159 |
| 5,097,277 | 3/1992 | Schmidlin et al. | 346/155 |
| 5,170,185 | 12/1992 | Takemura et al. | 346/159 X |
| 5,200,769 | 4/1993 | Takemura et al. | 346/159 X |
| 5,204,696 | 4/1993 | Schmidlin et al. | 346/155 |
| 5,343,844 | 9/1994 | Fukui et al. | 123/481 |

FOREIGN PATENT DOCUMENTS

| | | | |
|---|---|---|---|
| 0014464 | 1/1992 | Japan | 346/159 |

*Primary Examiner*—Robert Beatty
*Attorney, Agent, or Firm*—Ostrolenk, Faber, Gerb & Soffen

[57] ABSTRACT

A method and apparatus for improving printing quality in electrographic printers includes an electrode device for generating a latent electrostatic charge pattern from electric signals. The electrode device is arranged within a gap area between a particle carrier and a back electrode. During a portion of the operating cycle, preferably when no development is performed, a duel airflow that is charged with positive and/or negative ions is directed into the gap area to neutralize the electrostatic attraction forces between the toner particles, and the electrode device and for achieving a homogeneous charge level on the surface layer of the electrode device. A magnet can be positioned opposite the electrode device so as to attract toner particles.

38 Claims, 12 Drawing Sheets

METHOD AND APPARATUS FOR IMPROVING TRANSCRIPTION QUALITY IN ELECTROGRAPHICAL PRINTERS

The present invention relates to a method and apparatus for improving transcription quality in electrographical printers having electrode means for generating a latent electric charge-pattern from electric signals, which electrode means is arranged within an area between a particle carrier and a back electrode.

BACKGROUND OF THE INVENTION

U.S. Pat. No. 5,036,341 discloses an electrographical printer which, compared to electrophotographical or electrographical procedures, includes constructional simplifications and manufacturing cost savings. By using an electrode means, which is controlled according to the configuration of the desired pattern, certain openings of the electrode means are electrostatically opened and closed by an electrostatic field produced directly between the particle carrier and a paper sheet to achieve the technical simplification mentioned above. However, until now, a difficult problem to solve has been that the toner particles moving from the particle carrier through the electrode means are adhered to the carrier and form toner agglomerate, which successively causes deterioration of the printing quality and sharpness. The electrode means may include electrodes situated in rows extending in two transverse directions so that the rows of electrodes cross each other and conductors provided on an insulating carrier having pervasive apertures or the like.

A method described in European Patent No. 476,041 aims to correct this problem by blowing away the stuck toner particles using compressed air. However, only a very limited overpressure can be used because the toner particles must not blow out over the entire apparatus. Therefore, only a limited effect is achieved by this method.

Another problem which affects the transcription quality is the existence of variations in the relative distance between the electrode means and the particle carrier, between the electrode means and the back electrode, and between each of the electrode means, the particle carrier and the back electrode and the passing paper sheet. These variations depend on irregularity of the electrode means, which must be more accurately and precisely formed because the distance between the particle carrier and the back electrode is only about one or a few tenths of a millimeter.

Another problem is that the electrostatic field that is produced is disturbed by the presence of the toner particles and the presence of charges, for example ionized gases and recharged molecules which have been recharged by friction, on the insulating layer of the electrode means. Also, the insulating layer on the electrode means is charged by the toner particles.

These problems cause the printing quality to deteriorate after several pages if no actions are taken for cleaning the electrode means or charge control device.

European Patent 476,041 also teaches using a rotating magnet core in a developer roller to retrieve the toner particles from the electrode means, which is achieved by means of an extra strong cleaning magnet. The method is efficient, but has drawbacks, such as the attraction of thick layers of toner away from the toner container. The system requires that the rotation direction of the developer roller be reversed to clean the roller by means of a cleaning blade turning towards and away from the roller. The cleaning magnet can later be rotated to clean the electrode means. Tests have shown that the method is useful, but problems can occur because of the poor reliability of the cleaning blade and the magnetic influence of the cleaning magnet on the toner layer during the printing process.

Also, it is not enough to clean and remove the toner particles from the electrodes. A stable charge level must be maintained on the insulating layer of the electrodes. A method for maintaining a stable charge level is described in U.S. Pat. No. 5,307,092. According to this patent, a semiconducting surface material is provided on the electrodes to lead away the charges from the electrode or an antistatic layer, which is intermittent (for example, through continuous connection to ground), to lead away tribo charges.

OBJECT OF THE INVENTION

The object of the present invention is to provide a method and a device to improve printing quality by producing distinct lines without blurred edge areas and uniform quality over an entire printed sheet. These tasks have been solved in the present invention through charging the air in the gap area with positive and/or negative ions for neutralization of the electrostatic attraction force between the toner particles and between the toner particles and the electrode means and/or for producing a homogeneous charge level in the surface layer of the electrode means, during some part of the operating cycle of the developer, preferably during development. The device for accomplishing the method includes at least one ion generator arranged for generating ions and a distribution means provided for distribution of the ions generated by the ion generator to the gap area.

DESCRIPTION OF THE DRAWINGS

The invention will be described below in more detail with reference to the preferred embodiments shown in the enclosed drawings.

DETAILED DESCRIPTION OF PREFERRED EMBODIMENTS

Figure 1:
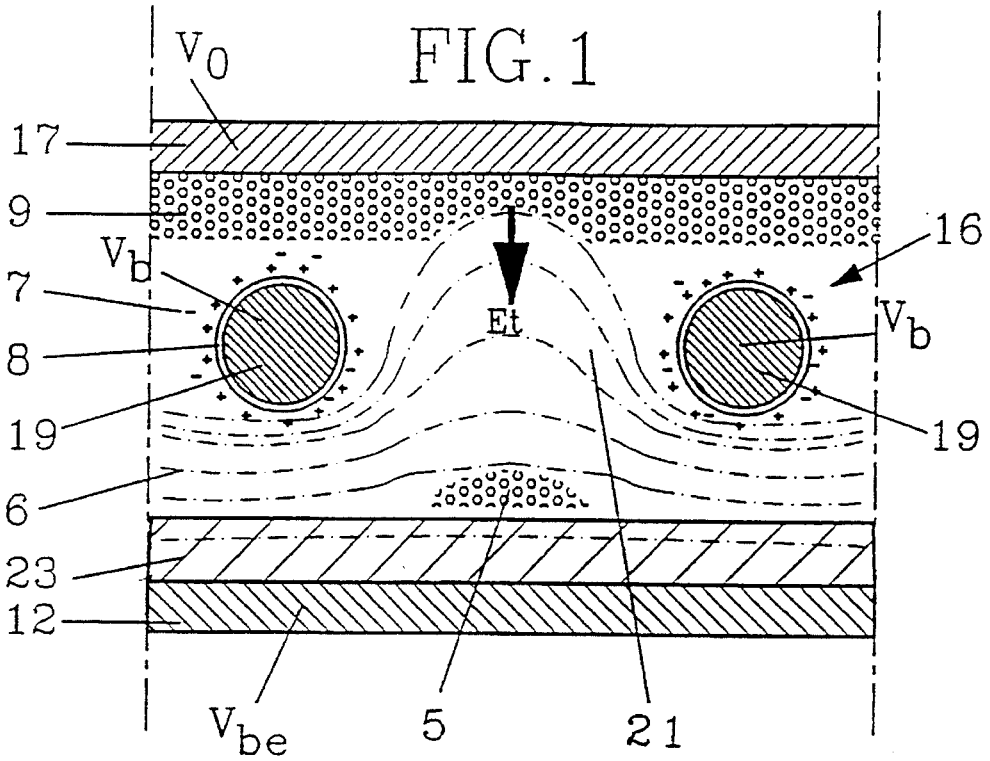
FIG. 1 is a schematic view of an extension of the potential field in the mesh of the electrode means.
Figure 2:
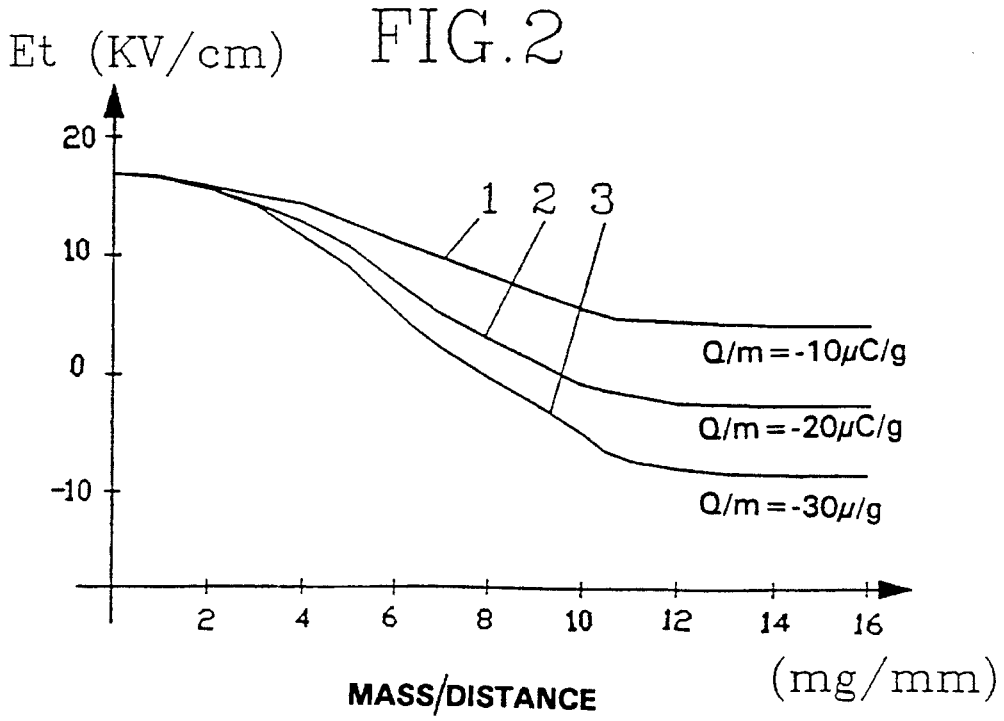
FIG. 2 is a graph illustrating the relation between the toner contamination and the attraction field strength.

FIG. 2 shows the relationship between the contaminated toner particles 9, and the attraction field force $E_t$ with respect to different charge levels according to FIG. 1, which illustrates the field extension between a particle carrier, also called a toner carrier 17, a back electrode 12, as well as, electrodes 19, included in an electrode means 16. In the electrode means 16, passages 21 for generating attraction forces between the toner particle carrier 17 and the back electrode 12 are opened and closed. By preventing the field from reaching the negative charged toner particles 9 on the particle carrier 17, no transfer of the toner particles onto the information carrier 23, i.e. the paper, to form a dot 5 is obtained. When transportation of the toner particles 9 is achieved, the electrodes 19, which limit the passages 21, are invisible from the view point of the electrostatic field. That is, the electrode potential has an equipotential level 6, as if no mesh existed. Transfer of toner particles occurs if:

$$F_m - mg < QE_t$$

Where $F_m$ is the resulting magnetic force and (other) attraction forces from toner particles towards the particle carrier;

mg is the gravity force;

Q is the charge of the particle;

$E_t$ is electrostatic field force, which acts on the toner particles,

Thus, the production of good toner charge per mass [Q/m] and generation of a good field strength [$E_t$] provides printed dots with good density. In FIG. 1, the particle carrier 17 has a potential $V_o$ applied and the back electrode 12 has a potential $V_{be}$ applied.

If the toner particles are exposed to a repetitive and stable propulsion field [$E_t$] during a certain time period, the resulting momentary potential of the electrode system must be the same from page to page. A reliable potential of the developer and the back electrode is obtained by using electric conductive material without an insulator. However, the contaminated charge toner particles and presence of charge 7 (ion gases and tribo charged molecules) on the surface of the electrode insulator 8 causes interference with the applied electrode potential.

A uniform layer of negatively charged toner particles on the surface of the electrodes leads to superimposement of the electrode potential $V_b$ and changes the attracting field $E_t$.

The lines 1–3 of the graph of FIG. 2 show the charge/mass relationship in toner particles with different charges (charge per mass Q/m [C/g]). For example, line 3 shows that a highly negatively charged (−30 μC/g) particle with high contamination can produce a negative directed attraction field, which can counteract the applied field. The lower the contents of impurities, the higher field strength. As it is shown in FIG. 2, the field force is independent of the charge of the particle in the range 0–2 mg/mm.

Figure 3:
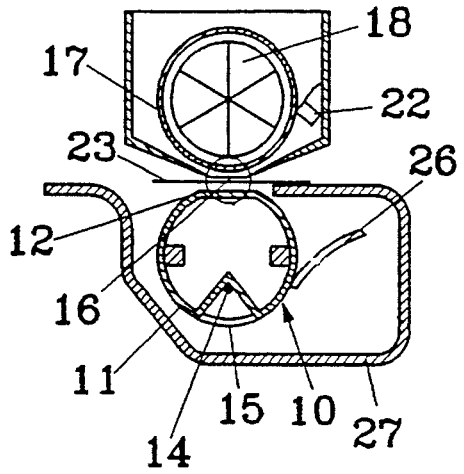
FIG. 3 is a cross-section view of the device according to one embodiment of the invention in a first stage of operation.
Figure 7:
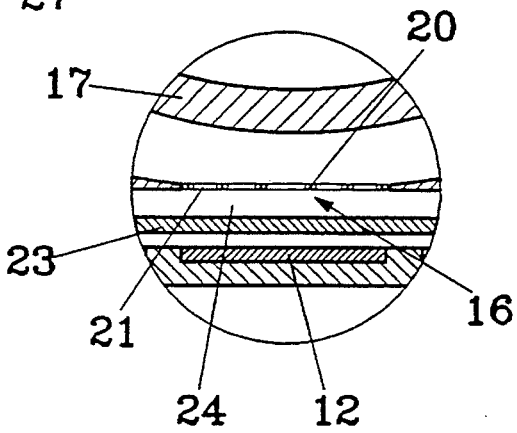
FIG. 7 is an enlarged detail view of the encircled part in FIG. 3.

In the embodiment shown in FIG. 3 and the detailed enlarged view of FIG. 7 includes a rotatable, roller-shaped particle carrier 17, in which a multi-pole magnet core 18 is arranged. A short distance outside the particle carrier 17, an electrode means 16 is located. The electrode means 16 can be formed of a net, in which each individual net mesh 20 forms a passage 21. These passages 21 can selectively and electrostatically be opened and closed by means of a control device not shown, by applying a control potential according to a configuration of a desired pattern, so that through the opened passages, an electrostatic field is exposed. This electrostatic field attracts adhesive toner particles from the particle carrier in a direction towards a back electrode 12 and an information carrier 23, e.g. a paper sheet, introduced in the space between the electrode means 16 and the back electrode 12. The electrode means 16 is consequently located in a gap area 24 between the particle carrier 17 and the back electrode 12. In FIG. 3, a phase in the operating cycle is shown, at which the toner particles are applied onto the paper 23, whereby the back electrode 12 is arranged facing the electrode means 16 to produce an attraction force.

The design of the electrode means 16 is not limited to the electrode matrix designs shown in the embodiment of FIGS. 3 and 7, being formed by a net having electrodes arranged in horizontal and longitudinal directions.

Figure 21:
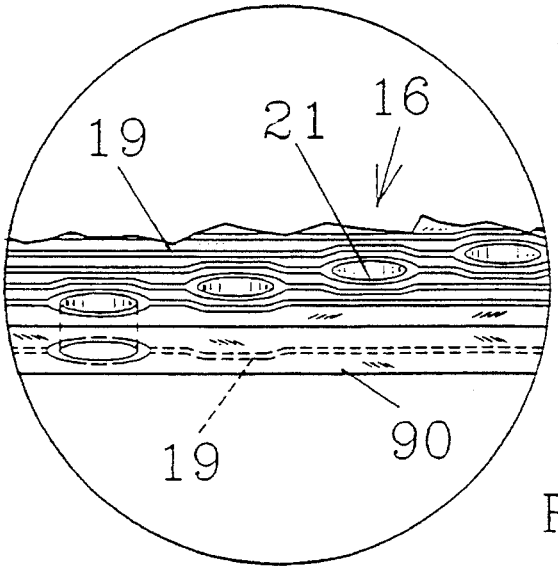
FIG. 21 is a perspective view of the encircled part of an electrode device shown in FIG. 20.

The electrode means can be formed by a dielectric carrier with a pervasive aperture having edges provided with an electrode layer so that a control field is produced between the electrode layers. The electrode means can be formed by the pervasive aperture surrounded by conducting material on an insulating carrier as shown in FIG. 21.

Figure 8:
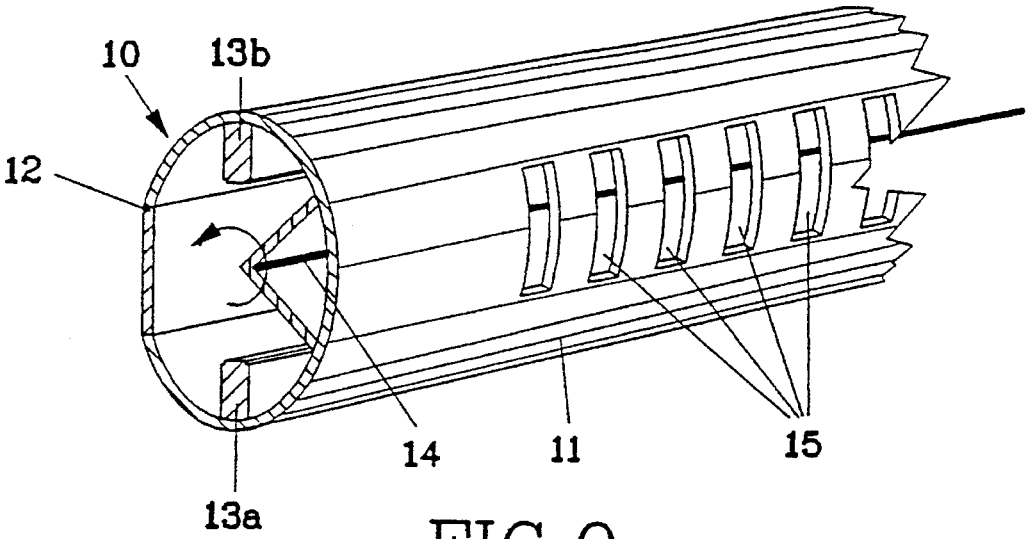
FIG. 8 is a perspective view of an example of a device operating as a back electrode and cleaning means.

The particle carrier 17 cooperates with a cleaning device 10 arranged on the other side of the electrode means, which according to this embodiment is combined with the back electrode 12. The cleaning device 10 includes a cylindrical hull 11, which includes the back electrode 12, two cleaning magnets **13*a* and 13*b* and an ion generator 14, e.g. formed by a corona wire. On the hull 11, a number of apertures or slits 15 are arranged as shown in FIG. 8, to allow ionized gases, generated by the ion generator 14, to be emitted from the hull 11. The cleaning device 10** is rotatable about its center axis.

The rotatable particle carrier 17 is arranged in a container holding the magnetic toner particles 9, which will be adhered to the developer roller. A uniform layer of toner particles is obtained by using a scrape blade 22 which is arranged to cooperate with the electrode means to provide a relatively constant amount of toner particles, which are attracted through the open passages in the matrix. Because the toner particles are conveying an electrostatic charge during the transportation on the particle carrier from the toner container and each individual passage 21 in the electrode means 16 has a very small opening, it is inevitable that certain toner particles are adhered to or around the passages 21, where the particles can be agglomerated, building larger clumps, which can obstruct the entire passage.

Figure 4A:
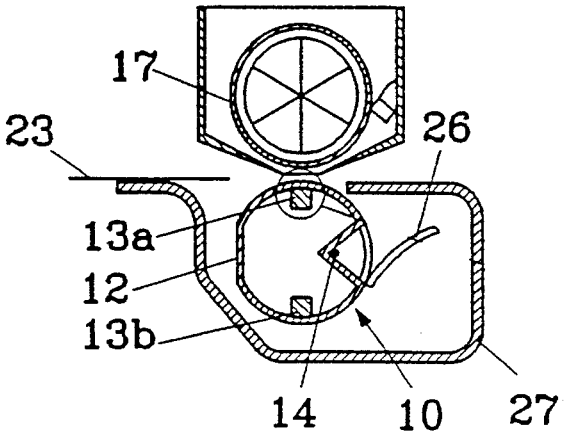
FIG. 4*a* is a cross-section view of the device shown in FIG. 3 in a second/stage of operation.
Figure 4B:
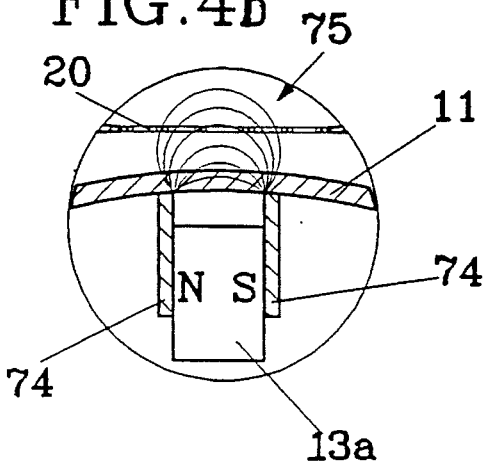
FIG. 4*b* is an enlarged detail view of the encircled part in FIG. 4*a*.
Figure 5:
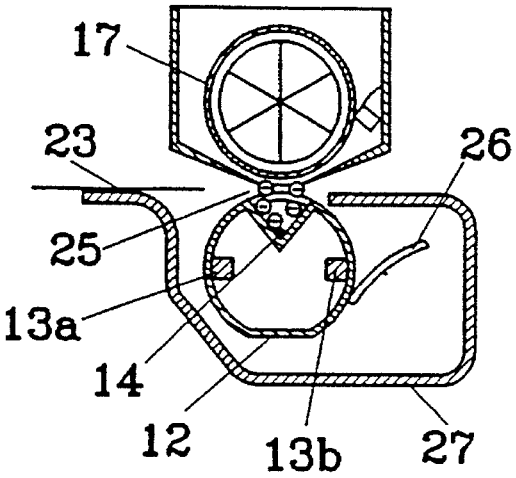
FIG. 5 is a cross-section view of the device shown in FIG. 3 in a third stage of operation.

FIGS. 4*a*–6 show sequences in the operating cycle when no charge pattern is obtained. After output of the paper sheet 23, the hull 11 is turned with the cleaning magnet 13*a* facing the electrode means 16 and attracts some toner particles stuck thereon, as shown in FIG. 4*a*. Some toner particles are not attracted off and away from the electrode means 16 so that these remaining particles adhere to the electrode means 16 because of the electrostatic forces. According to another embodiment of the present invention, these remaining toner particles adhered to the electrode means are removed by charging the air in the gap area 24. More specifically, during some portion of the developing process when no charge pattern is obtained, the air in the gap area 24 is provided with positive and/or negative ions 25, which are capable of neutralizing the electrostatic attraction force of the toner particles, so that their adhesive bonding to each other and to the electrode means 16 is removed. As shown in FIG. 5, an airflow or an ion flow, which is relocated by means of an electrostatic field, is supplied at and distributed through the gap area 24. This air or ion flow is charged with or contains ions 25, the majority of which have an opposite polarity than the polarity of the toner particles adhered to the electrode means 16. A scraper 26 is arranged to contact the surface of the cylindrical hull 11 for removal of the toner particles. After the toner particles are removed by the scraper 26, they fall into a waste container 27. Another cleaning magnet 13*b* is arranged to clean and remove particles which remain in the gap area 24 after the ionization process.

FIG. 4*b* discloses an example of a method to provide magnets 13 in a number of holders, so-called pole shoes 74, which are formed essentially of magnetic material. The magnet 13 is arranged slightly spaced from the hull 11 between the pole shoes 74. Because of the magnet poles (S, N), a magnetic field 75 is produced between the end of the pole shoes mounted against the hull 11. The magnetic field 75 extends towards the electrodes 20 and attracts or repels the toner particles stuck on these electrodes against or off of the cleaning device 10.

Figure 19:
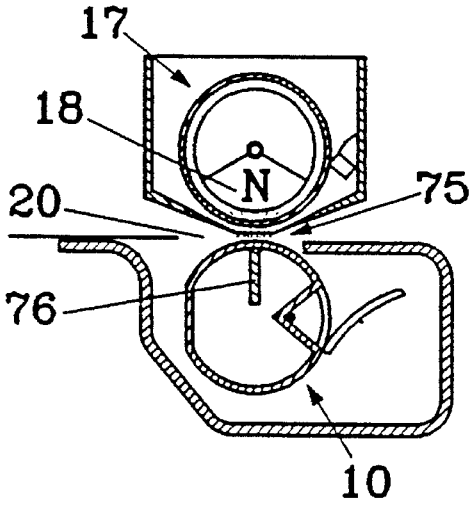
FIG. 19 illustrates another embodiment of a cleaning device using a magnet according to the present invention.
Figure 6:
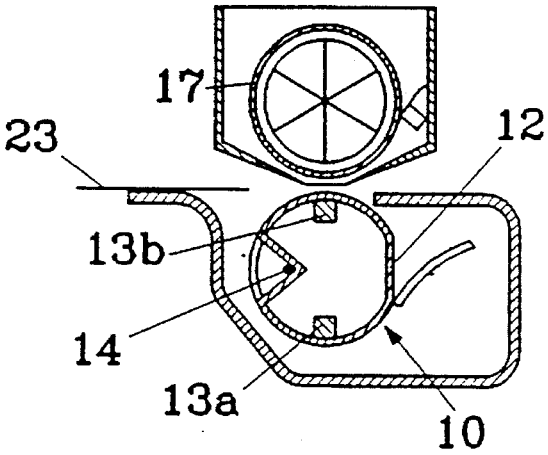
FIG. 6 is a cross-section view of the device shown in FIG. 3 in a fourth stage of operation.

FIG. 19 also schematically illustrates a method of cleaning the electrode means 20 using magnets. The magnet in the cleaning device 10 is substituted by a magnetic material 76 forming an attraction pole. When this attraction pole 76 is placed in front of a magnet 18 arranged in the toner carrier 17, a magnetic field 75 is directed from the toner carrier 17 towards the attraction pole 76. This field 75 attracts or repels toner particles that are stuck on the electrode means 20.

Figure 9:
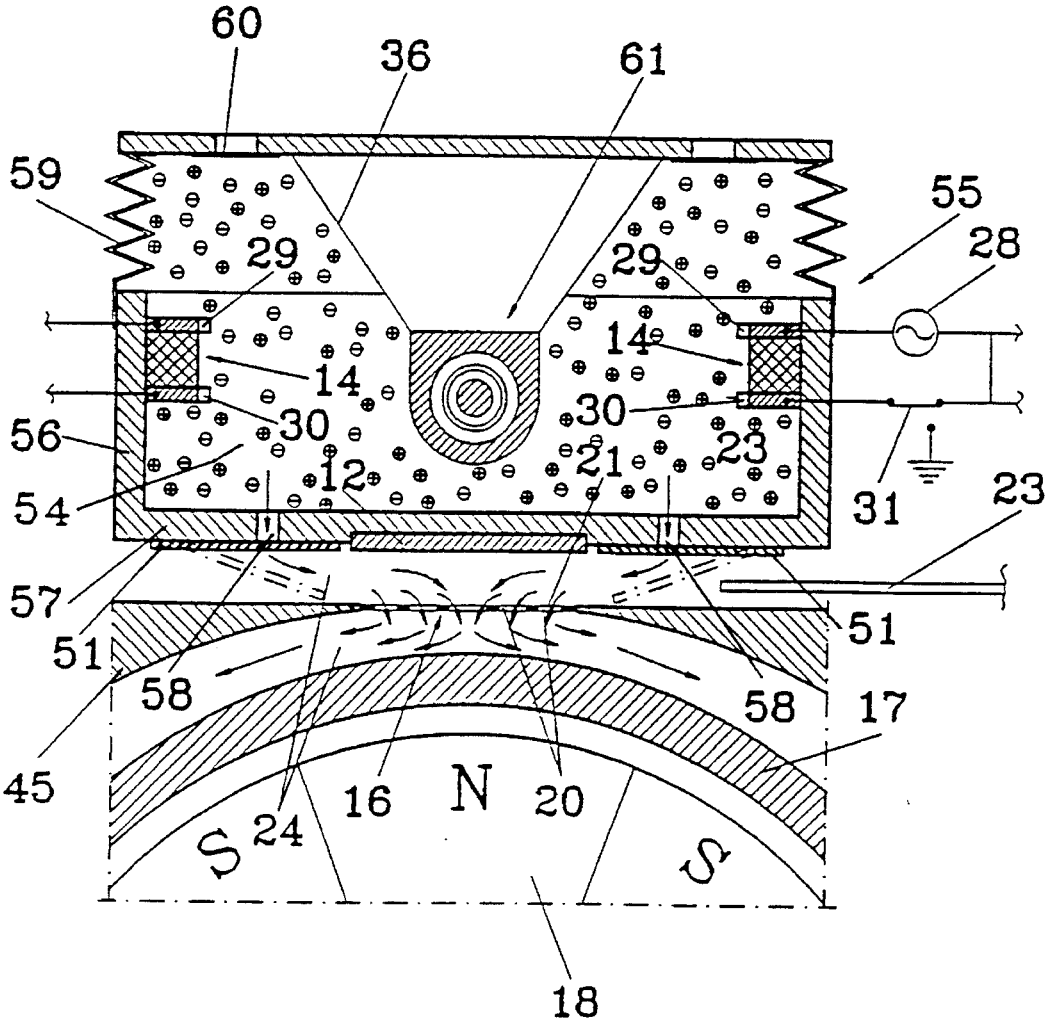
FIG. 9 is a cross-section view of another embodiment of the invention, in the gap area of which an air overpressure is produced.

According to FIG. 9, the airflow into and distributed through the gap area 24 is provided by an air compressor 55, which in the shown embodiment, includes a pressure box having a vessel 56. A bottom 57 of the vessel 56 receives the back electrode 12 and apertures or slits 58 are formed on both sides of the back electrode 12. At the open end of the container, a bellows 59 and a pressure plate 60 are arranged, on which a movement mechanism 61 can be seen. Inside the accommodation 53 of the compressor 55, an ion generator 14 is provided. A high alternating voltage 28 is connected to one of the two electrodes 29, 30 of the generator 14. The electrodes 29,30 are separated by a dielectric spacer means. A switch 31 is provided so that the ion generator can either be connected to an alternating voltage or to ground.

Accordingly, the compressed air produced by the compressor 55 contains a certain amount of ions, which under the short dwell times between the output of a full written sheet and input of a new unwritten sheet, is allowed to flow through the electrode means 19 which is provided on a holder 45. In this manner, the adhesive toner particles are removed when their electrostatic attraction force is reduced or removed. The air flow is relatively small and must not be so large that it removes the toner particles located on the particle carrier 17.

Figure 20:
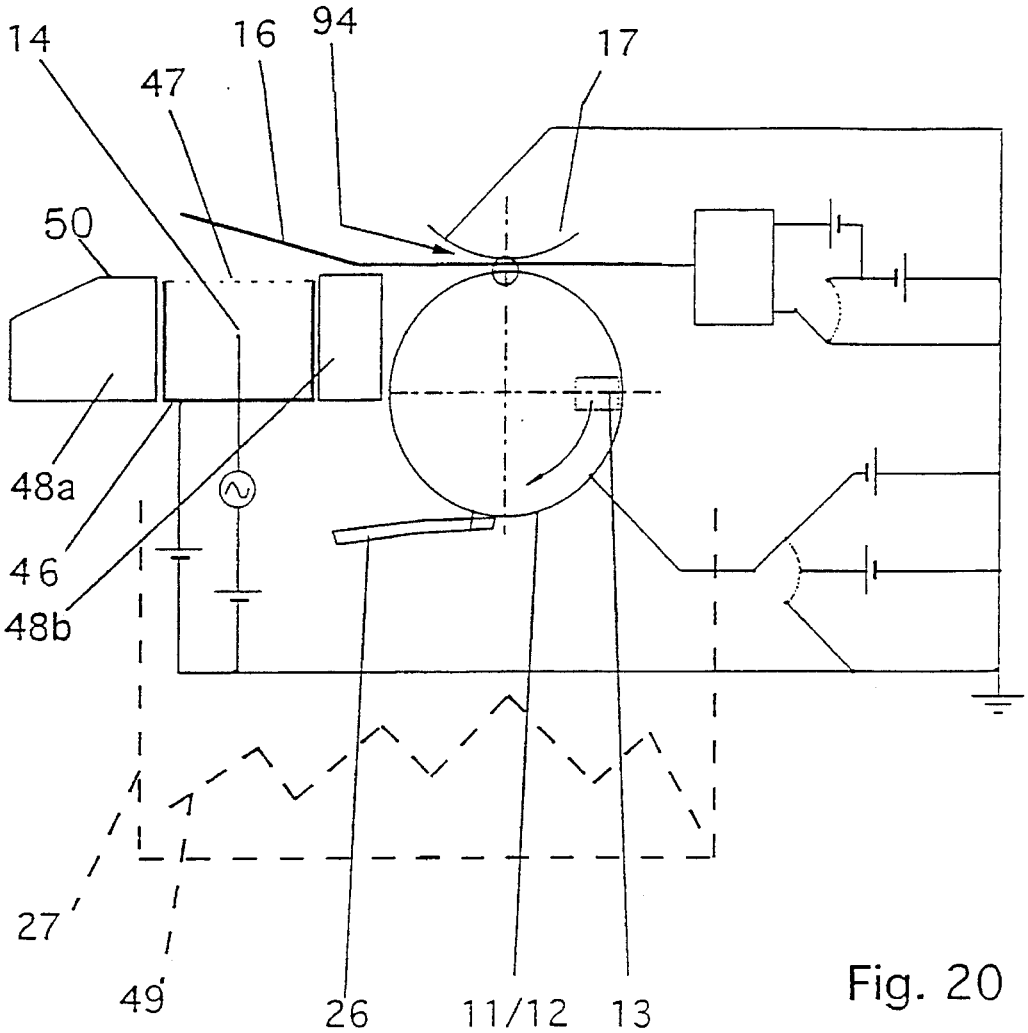
FIG. 20 is a schematic cross-section view of an embodiment of the cleaning device, according to the invention, mounted on a mobile shuttle.

FIG. 20 illustrates an embodiment, in which the cleaning device is formed of two parts. The first part comprises the cylindrical hull 11, including the back electrode 12 and cleaning magnet 13. In this case, the back electrode is not a separate part of the hull 11, but the entire hull 11 except an area adjacent the cleaning magnet 13 can be used as a back electrode.

The second part includes an ion generator, arranged in a housing that acts as a paper guide 48a and paper transfer means 48*b*. The ion generator comprises at least one corona wire 14 arranged in a conductive case 46, a so-called scorotron, which on a side facing the electrode means 16 has a grid 47, through which the ions are directed towards the electrode means 16. Both of the above-described parts and a container 27 for collecting the wasted toner particles 49 are arranged on a mobile conveyer, called a cleaning shuttle 50, which moves axially on guide rails or the like by means of driving means, such as step-motors (not shown).

Figure 22:
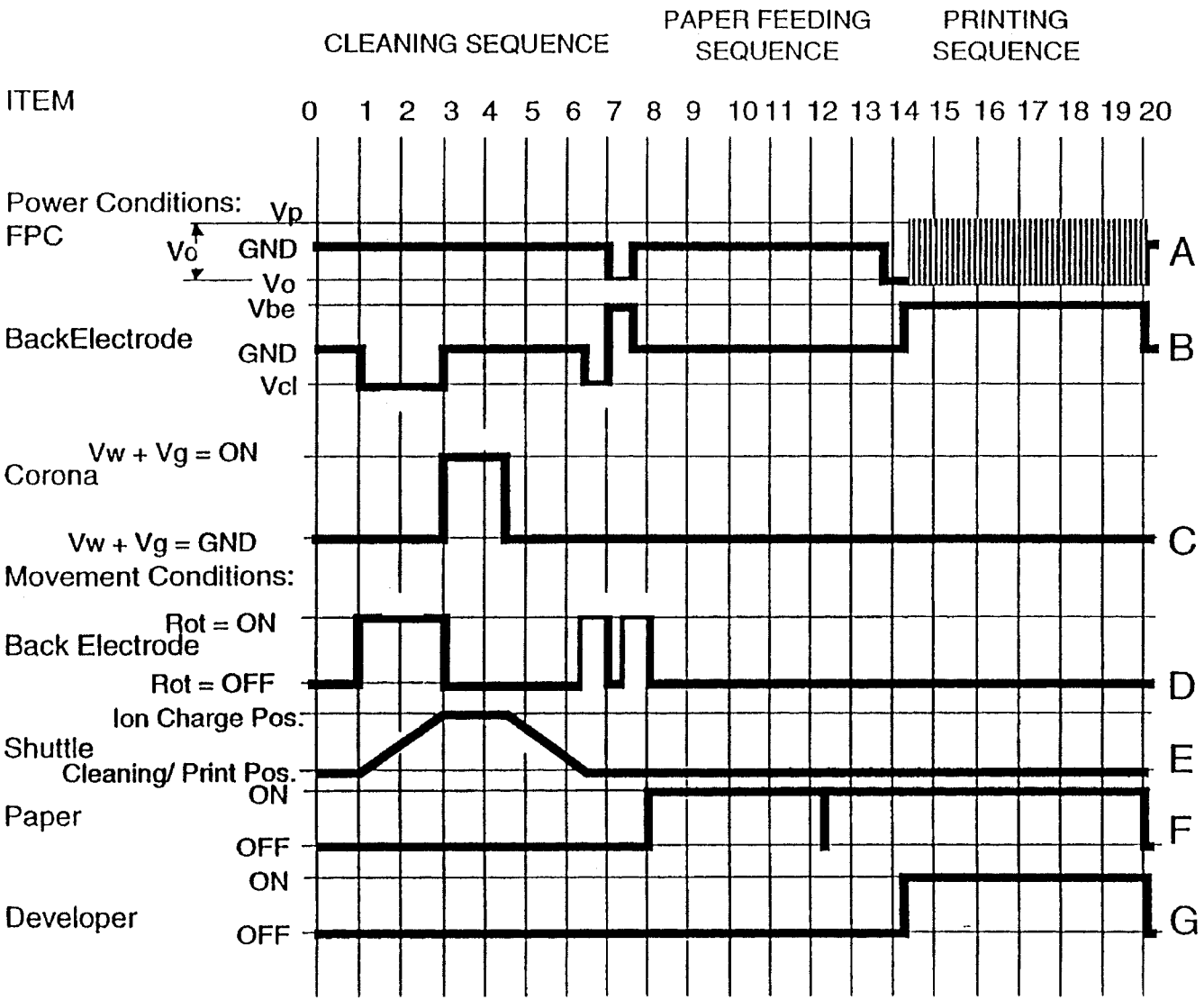
FIG. 22 is a schematic diagram illustrating the function of the embodiment shown in FIG. 20.

To clarify the function of the above embodiment, a sequence diagram in FIG. 22 shows the control signals connected to the different parts of the embodiment. The diagram is divided in twenty time units, comprising three sequences: cleaning sequence, paper feeding sequence and printing sequence. In two sections, the control signal power levels and movement conditions are shown. In the diagram:

Graph A shows a control voltage $V_c$ supplied to the electrode means 16 which varies between offset voltage $V_o$ and print voltage $V_p$;

Graph B shows a control voltage supplied to back electrode 12, which voltage varies between back electrode voltage $V_{be}$ for printing and cleaning voltage $V_{c1}$;

Graph C shows corona 14 voltage $V_{cr}$, comprising corona wire voltage $V_w$ and grid 47 voltage $V_g$, ranging between OFF and ON;

Graph D shows the rotation of the back electrode 12;

Graph E shows the movement of the cleaning shuttle 50;

Graph F shows the paper feeding; and

Graph G shows the rotation of the particle carrier 17.

After a printing sequence, the following cycles are performed: $V_c$ is zeroed (grounded). The back electrode is rotated and simultaneously connected to a cleaning voltage $V_{cl}$ and the ion generator in the cleaning shuttle is moved towards the printing zone 94 (FIG. 24), which is in front of the apertures of the electrode means 16. During the rotation of the back electrode, some toner particles adhered on the electrode means are attracted to the cleaning magnet. When the ion generator is in position, the voltage levels of the corona wire and the grid are adapted to generate ions ($V_w$ and $V_g$=ON), which are directed towards the electrode means due to potential difference. The voltage supply for $V_w$ is an AC and/or DC power supply for generating positive and/or negative charged ions to neutralize both negative and positive charged toner particles, the surface of the electrode means or charge both the particles and the surface. During the electrical cleaning of the electrode means, i.e. by means of ions, the voltage of the back electrode is alternated to ground. After the electrical cleaning of the electrode means, the cleaning shuttle is moved back to its original position, whereby the cylindrical back electrode is positioned in the print zone and rotated. During the rotation, the cleaning magnet passes the print zone 94 and attracts the remaining toner particles. The number of rotations can be varied, but to achieve a good cleaning result, the back electrode is rotated in two separate periods, between which the voltage of the back electrode and particle carrier is altered, to remove the undesired left over toner remaining on the particle carrier.

During the rotation, the wasted toner particles attracted from the electrode means and adhered to the cylindrical hull are scraped off by means of cleaning blade 26 and fall into the waste toner container 27.

In the next sequence, the paper is fed into position for the next print job, whereby the control signals of the back electrode and electrode means are set to zero (ground).

In the printing sequence, the control signal of the back electrode is altered to $V_{be}$ and the particle carrier roller 17 is rotated to supply the toner. The apertures of the electrode means are energized with appropriate voltage ($V_p$) to open and close passages in the electrode means to transport the toner from the particle carrier to the paper.

One possible embodiment similar to the above described embodiment uses a plane back electrode and places the cleaning magnet in the paper guides, e.g. 48*b*, and a folding cleaning blade above the paper guide. The cleaning magnet cleans the electrode means before and after ionization, and the magnet is cleaned on the way back to the parking position of the cleaning shuttle 50 by means of the folding cleaning blade.

One advantage with the above described embodiments compared to the embodiment shown, e.g. in FIG. 8 is that in the latter embodiment, when the cleaning blade cleans the surface of the hull during the rotation of the cylindrical hull 11, the scraped toner particles may be transported through slits 15 into the space where the corona wire 14 is located. The accumulation of the toner in this space may disturb the ion generation. Placing the ion generator separately prevents this drawback.

The voltage and time requirements in the above description of the diagram are by way of example and can be varied with respect to the type of toner, the information carrier (paper), etc.

A magnified view of an embodiment of the electrode means 16 is shown in FIG. 21. The electrodes 19 are arranged on a supporting member 90 and include apertures 20. Each aperture 20 is surrounded by one electrode 19 in one or both sides of the supporting member 90.

Figure 25:
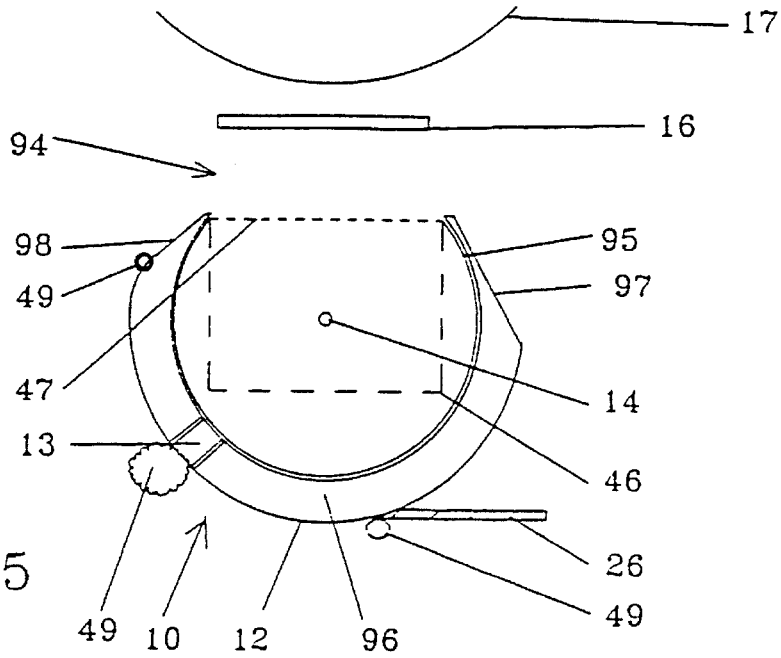
FIG. 25 is a schematic view of another embodiment according to the present invention with a stationary ion generator and rotating back electrode.

Also, it is possible to have a movable cover located inside or outside the cylindrical hull 11, which moves in front of and covers the grid or openings 15/47. One embodiment according to this principle is shown in FIG. 25, in which the ion generator is placed in a stationary carrying member 95, while the rotatable cleaning member 10 is arranged as a partially circular outer cover 96 including the cleaning magnet 13 and acting as the back electrode 12, and having chamfers 97 and 98 at the end of its shanks. The ion generator formed by the scorotron 46 can be provided with a spring, cam discs or the like (not shown) to be located closer to the electrode means.

Following an ion generation sequence, the outer cover 96, rotates in this case counterclockwise, whereby the cleaning magnet 13 passes by the print zone 94 and electrode means 16 and attracts the toner particles adhered thereon, as the outer cover 96 covers the grid 47. In the next rotation when the cleaning magnet 13 with the wasted toner 49 attached thereon passes the cleaning blade 26, some toner particles are scraped off, but some may still be left on the cleaning blade 26. When the cover 96 rotates, the cleaning blade passes the chamfer 98 and the contact between the blade 26 and the surface of the cover 96 discontinues, whereby only an insignificant amount of the wasted toner 49 may be left on the surface of the curve of chamfer 98. This left over toner may accumulate due to repeated cleaning, but will not extend a distance longer than the tip of the cleaning blade. The chamfer 97 is arranged to make the contact between the surface of the hull 96 and the cleaning blade smoother, in further rotation.

Figure 23:
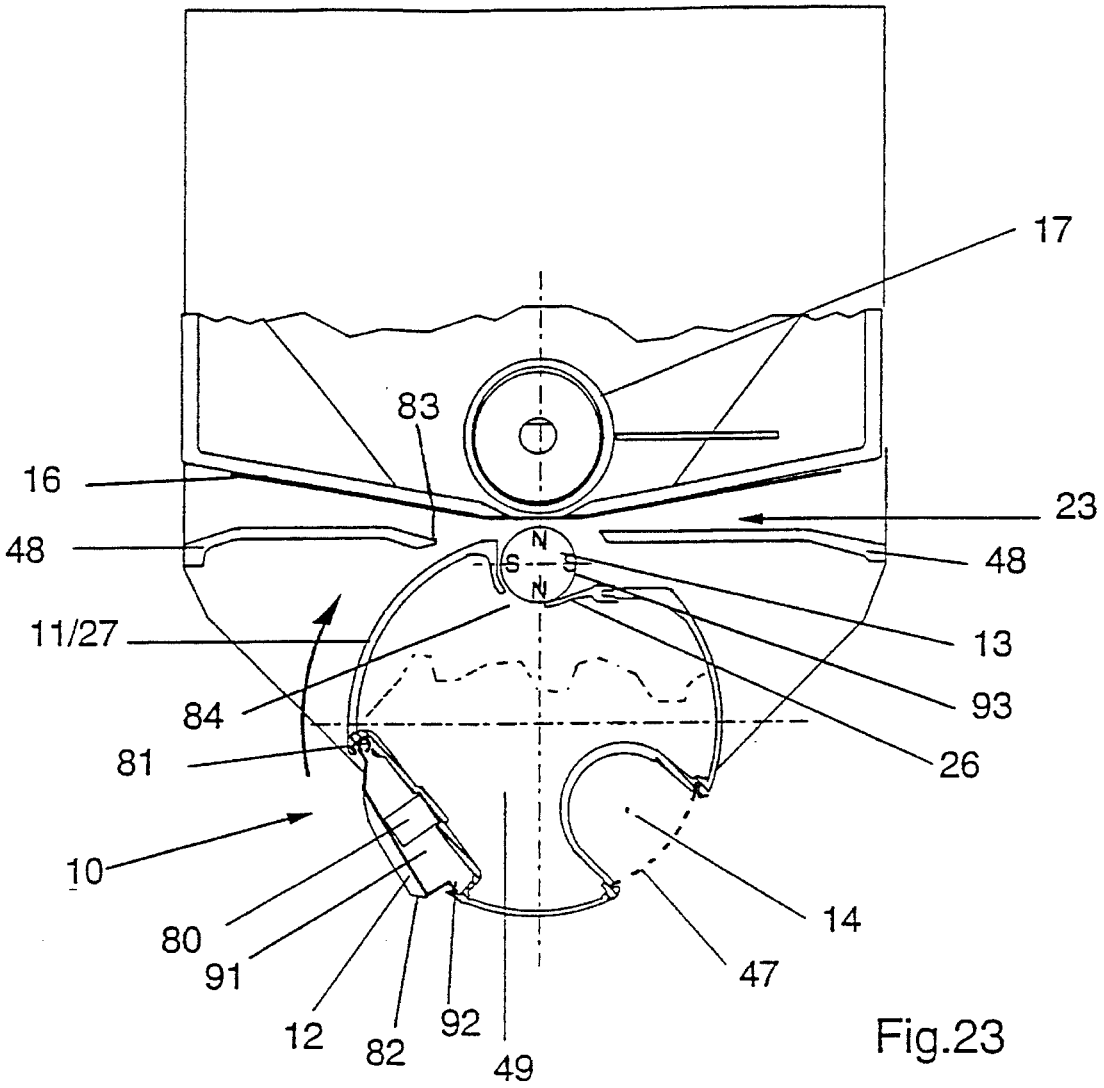
FIG. 23 is a schematic view of an embodiment in which the waste container is integrated in the cleaning device casing.

In the embodiment shown in FIG. 23, the waste container for wasted toner 49 is integrated in the cylindrical hull 11 of the cleaning device 10. A circular cleaning magnet 13 is arranged separately outside the hull 11 and is rotatable about its axis. The accommodation 93 is arranged on the hull 11 so as to partially enclose the cleaning magnet 13. In the bottom portion of the accommodation 93, an opening 84 is provided with a cleaning blade 26 arranged on one of the walls surrounding the accommodation. The blade 26 projects from the wall towards the surface of the cleaning magnet 13. On the hull 11, a recess 91 is provided in which the back electrode 12 is removably mounted by means of a pivot 81 and is spring-loaded by a spring 80, which pushes the back electrode outwards from the bottom of the recess 91 and towards a blocking surface 92, which in cooperation with a corresponding projection on the back electrode, secures the back electrode 12 in the recess 91. The ion generator, including corona wire 14 and grid 47 is provided in a space formed in the hull 11.

After a print job, the cleaning device 10 is rotated and the ion generator is placed in front of the electrode means 16. The surface of the electrode means is bombarded with the ions, whereby possible adhered toner particles and/or surface of the electrode means are neutralized or charged. Then, the cleaning device is rotated and the cleaning magnet, which follows the rotation of the cleaning devices by means of separate driving means or force from the wall of the accommodation 93, is placed in front of the electrode means 16. The magnet 13 is rotated about its center axis, whereby the adhered toners on the electrode means are attracted to the magnet and scraped off by means of the cleaning blade 26 and collected in the cylindrical hull 11 through opening 84.

Before the next print job, the cleaning device 10 is rotated to place the back electrode in front of the electrode means in the print zone. To achieve an accurate distance between the electrode means 16 and the back electrode 12, there is arranged on one end of the paper guide 48 adjacent to the print zone, a contact surface 83, which in cooperation with a corresponding surface 82 on the back electrode 12, adjusts the distance between the electrode means and the back electrode 12.

The hull 11, for example, can be made of non-polluting plastic or recyclable material to be changed when it is filled. A sensor can be provided in the hull 11 for generating an alarm when the hub is filled. In this case, it is not necessary to change the cleaning magnet 13. Also, here the wasted toner is collected in a container without contaminating the ion generator space.

Figure 24:
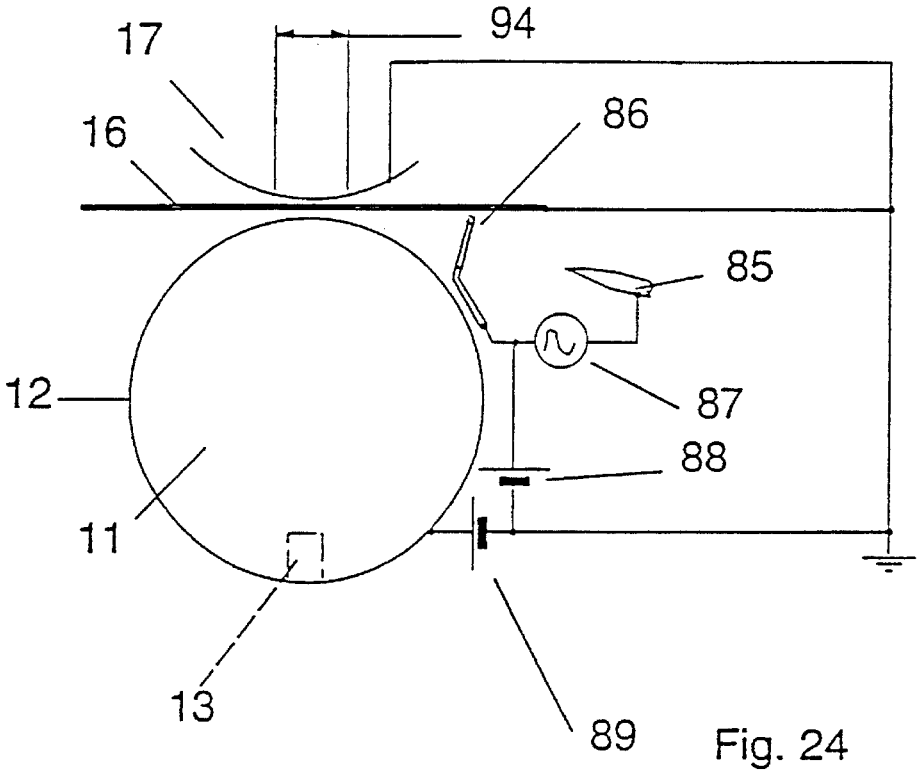
FIG. 24 is a schematic view of another embodiment of the cleaning device provided with an ion fan.

In the embodiment shown in FIG. 24, the ion generator is fixedly located in an area separate from the hull 11. The technique is called "ion fan". In the ion generator space, a needle 85 or the like is arranged so as to be directed at the print zone and the electrode means 16. Also, here the back electrode 12 is arranged to be cylindrical or shaped as a roller, in which a cleaning magnet 13 can be provided. Between the ion needle 85 and the electrode means 16, a hole bar 86 is arranged. By connecting a voltage source 87 between the ion needle 85 and the hole bar 86, ions are generated and directed towards the electrode means 16. The movement of the ions causes the air to move, whereby an air flow is generated in the space between the electrode means and the back electrode in the print zone 94. The ionized air flow neutralizes the toner particles adhered to the electrode means, whereby upon rotation of the back electrode, when the cleaning magnet 13 passes the electrode means, the adhered toner is attracted onto the cleaning magnet and removed from it by means of the cleaning blade (not shown). The hub 11 is connected to a voltage supply 89. The bar 86 can be connected to a DC voltage supply 88.

In FIGS. 9 and 11–15, an embodiment including a simple and inexpensive compressor located inside of the ion generator 14 is shown. The movement mechanism 61 includes a central screw 32, provided in the end gables of the container 56 and which screw 32 operates by means of a coupling device 33 of the driving device, which is included in the printer for other functions. A socket 34 is arranged on the screw 32, which by means of a coupling part 35 is interconnectable and disengageable respectively from the screw 32. The socket 34 is, by means of the connection links 36, in jointed connection with the pressure plate 60, so that a dislocation of the socket along the screw 32 results in a compression and a decompression stroke, respectively, with the pressure plate 60.

The coupling 35, in its simplest form, includes a coil spring 37, whose one end portion 43 extends through a recess 38 in the socket 34 and which can be made to cooperate with a ramp 39 located outside the socket. In the recess 38, a shelf 40 is arranged. The shelf 40 is located so that the projecting end portion 43 of the coil spring can be engaged under the shelf, whereby the coil spring is tensioned so that it engages threads 41 of the screw 32. On the screw 32, a stop 42 is also provided, which cooperates with the projecting end 43 of the coil spring 37 so that the stop 42 dislocates the end portion 43 from engagement with the shelf 40, so that the coil spring will take one of the positions shown in FIGS. 13 and 15, with expanded coil spring 37, which thereby releases the screw 32. A pressure spring 44 is tensioned between one gable of the container 56 and the socket 34 when the compressor performs an expansion stroke.

Figure 11:
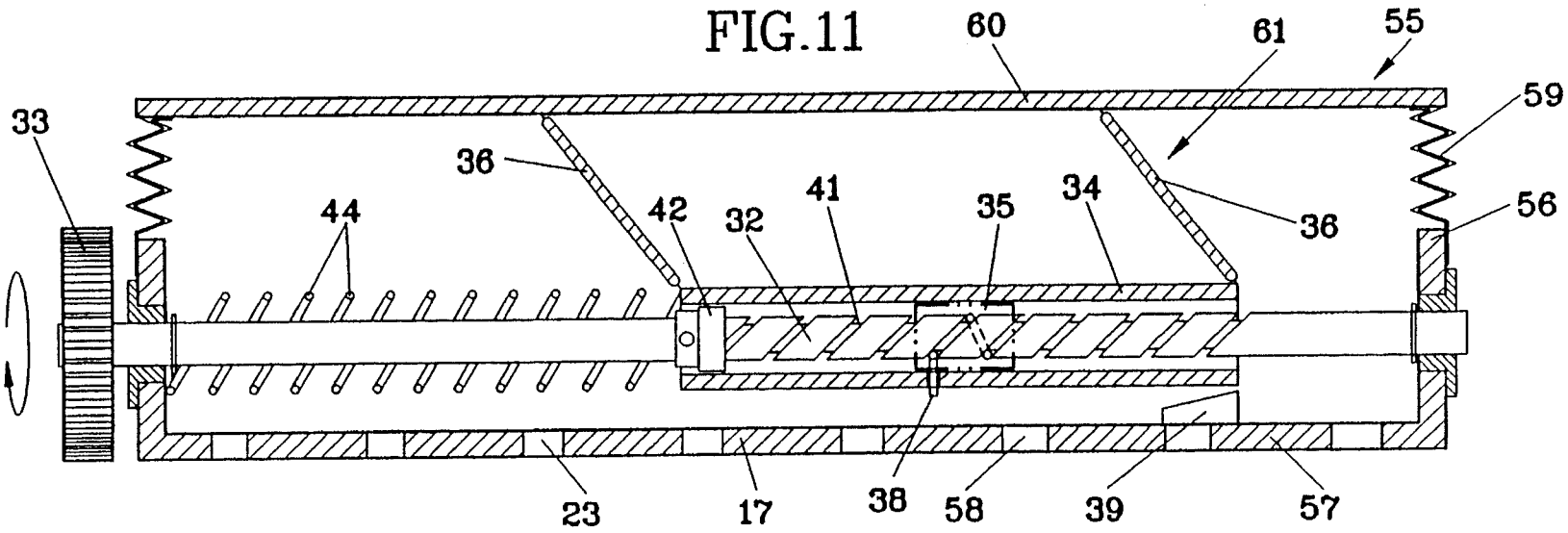
FIG. 11 is a cross-section view of an air compressor according to one embodiment of the invention, integrated with a back electrode and an ion generator.
Figure 15:
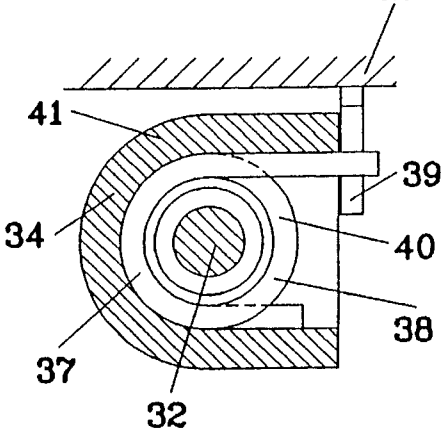
FIG. 15 is a cross-section view along the line XV—XV in FIG. 14.
Figure 14:
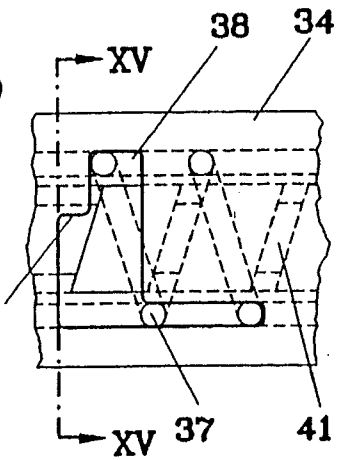
FIG. 14 illustrates a front view of a part of the compressor movement mechanism with the coupling means in disengaged position.
Figure 13:
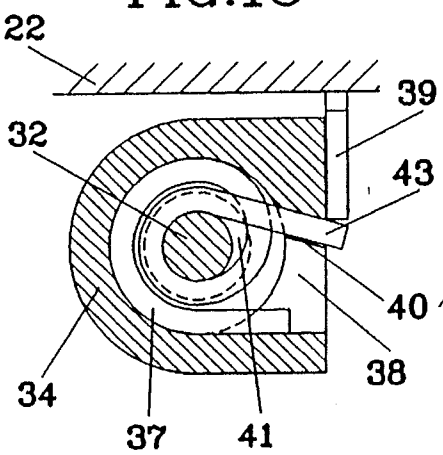
FIG. 13 is a cross-section view along the line XIII—XIII in FIG. 12.
Figure 12:
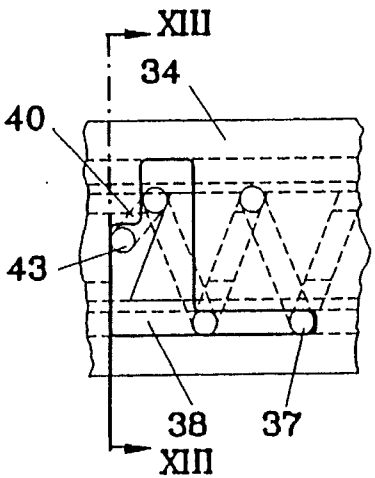
FIG. 12 illustrates a front view of a part of the compressor movement mechanism, with the coupling means in an engaged position.

The movement mechanism 61 functions in the following way. It is assumed that the coil spring 44 has released the screw 32 and the compression spring 44 has pressed the socket to its one extreme position, i.e. in the direction against the opposite end of the gable and that the bellows 59 is in its compressed state (FIG. 11 discloses an intermediate position). In this extreme position, the projecting end portion 43 of the coil spring 37 cooperates with the ramp 39 and the end portion 43 has been engaged behind the shelf 40, which means that the socket is interlocked with the screw. Now, if the screw 32 is rotated in the direction of the arrow, the socket is dislocated in a direction towards the compression spring 44, which is compressed at the same time that the connecting links 36 rises and the pressure plate 60 is displaced in a direction off the socket. When the connection links 36 assume essentially a vertical position, the pressure plate 60 has attained its extreme position and the coil spring 44 is in its compressed condition. In this position, the end portion 43 engages the stop 42, which presses the end portion 43 out from its engaged position so that the coil spring 37 can expand and release the screw 32, at the same time that the compression spring 44 quickly removes the socket to its starting point, during simultaneous dislocation of the pressure plate 60 in a direction towards the bottom of the container 57, in which the apertures or the slits 58 are provided, through which the compressed air exits in a direction towards the gap area 24. During the expansion stroke, the air taken in the compressor is charged with ions emitted from the ion generator 14, so that the retiring airflow serves as a transport medium for the ions.

To direct the airflow from the compressors 55 to the gap area 24, flaps 51 are provided in the middle of the bottom of the container 57 just in front of the apertures 58. The flaps 51 and the apertures 58 form a flapper valve. The flaps 51 are arranged and formed so that they bear against the bottom of the container 57, when the container 56 is depressurized, but are lowered by the outpouring air, when the compression stroke is executed. Thus, the end sections of the flaps 51 will press on the paper 23.

Figure 10:
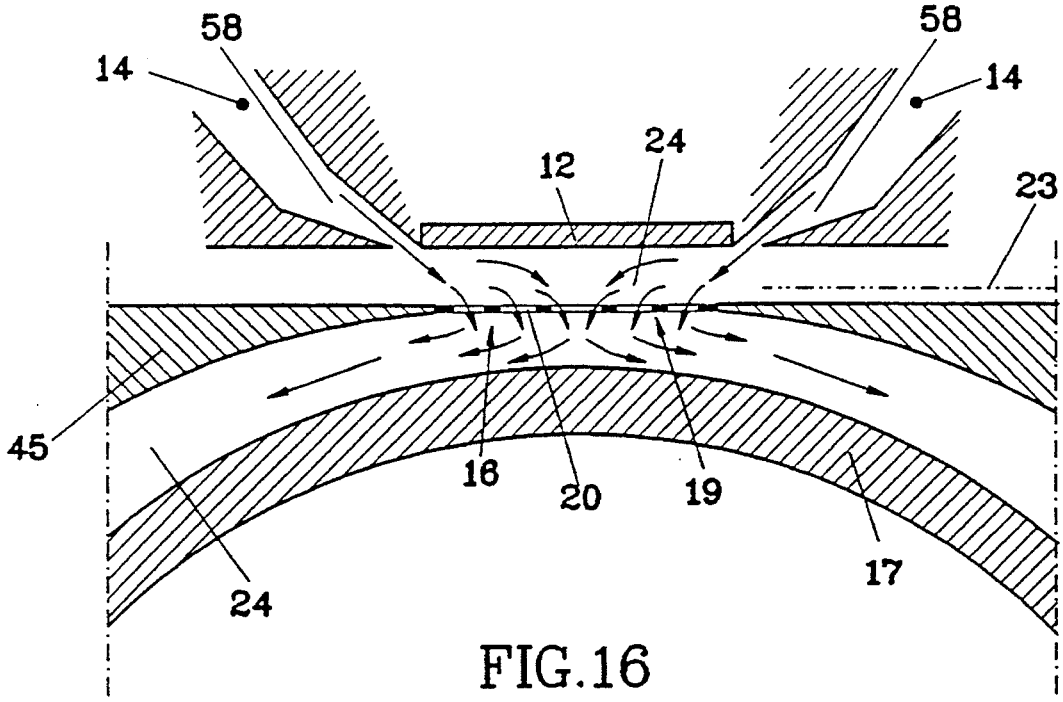
FIG. 10 is a cross-section view of a part of an electrostatic printer provided with an air overpressurization device according to one embodiment of the present invention.

According to FIG. 10, nozzles 58 are provided on both sides of the back electrode 12 so as to extend along the entire length of the electrode means and the back electrode, respectively (in the drawing, perpendicular to the drawing plane), which for instance can correspond to the width of a paper sheet, i.e. 210–220 mm. The nozzles 58 are directed into the gap area 24, so that the air beams converge in the center portion of the gap area and are deflected through the electrode means and into the annular gap area 24, which surrounds the developer roller 17.

Ion generators 14 are provided near the back electrode 12. The ion generators 14 are temporarily connected during the intermediate periods when no charge pattern is obtained in the electrode means 19. The air passing by the ion generators 14 will consequently be enriched with ions, which are forced to pass through the passages 21 of the electrode means 16 so that the adhesive toner particles are removed from the electrode means 16.

The air beams from the nozzles 58 are directed towards each other and deflected over the entire electrode means so that a uniform distribution of the air beams over the entire surface of the electrode means is obtained. Further, by this arrangement of nozzles 58, air blowing to the area around the electrode means is prevented so that unwanted airflow in the gap area outside the matrix is avoided. Thus, the air emitted from the nozzles 58 does not affect the feed of the paper sheet. The annular gap 24 located about the particle carrier 17 is in communication with the atmosphere so that the slight overpressure which is generated in the annular gap 24 is quickly lowered to atmospheric pressure and consequently, any overpressure exists in the toner carrier.

Figure 16:
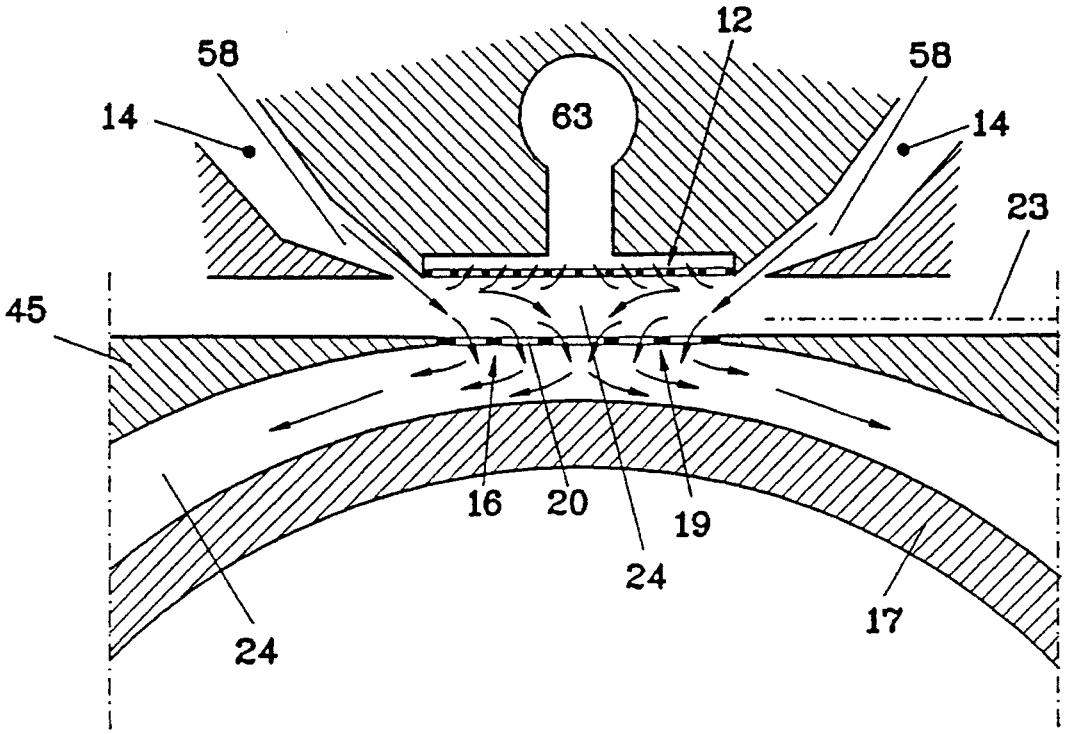
FIG. 16 is a cross-section view of another modified embodiment according to the invention.

The embodiment according to FIG. 16 differs from the embodiment according to FIG. 10 in that the back electrode 12 is perforated. The back electrode 12 can be formed as a net, where the masks form the perforation.

If the paper feeding should jam during a development process and the paper is not fed into the position above the electrode means, the toner particles may pass through the electrode means and get stuck on the back electrode. Consequently, it is also desirable to clean the back electrode 12 preferably at the same intervals that the electrode means 16 is cleaned, i.e. between the printing of two sheets. In certain cases, it is desirable to use the pressure sequence itself to hold the information carrier or the paper sheet 23, against the back electrode 12. This can be done by creating a low pressure in the accommodation 63, which causes the paper to adhere to the back electrode with an adhesion force that is not so large that the paper can not be fed by the electrode means. During the cleaning process, the air which is supplied to the accommodation 63 can be guided back to the annular gap 24 or in some other manner transported away and eventually filtrated before it is discharged to the atmosphere.

Figure 17:
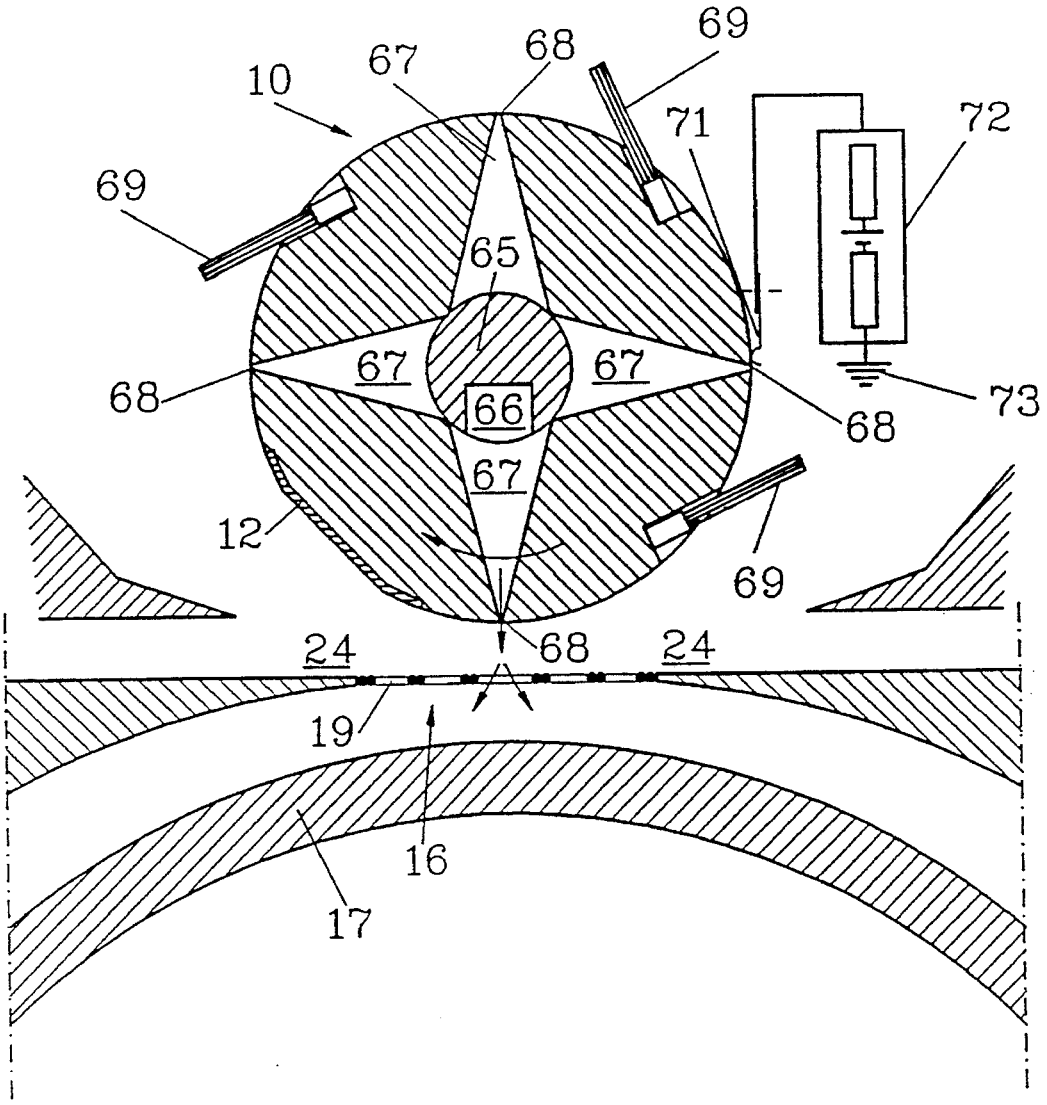
FIG. 17 is a cross-section view of another embodiment of the present invention.

In the embodiment shown in FIG. 17, the back electrode 12 is arranged in the periphery of a roller member 10 which is rotatable about a shaft 65. In the stationary axis 65, a feeder 66 from a non-illustrated compressed air source is arranged to provide for ionization of the air. During rotation of the roller 10, the feeder is located to communicate with distribution channels 67 formed in the roller. The channels 67 discharge air at the periphery of the roller through nozzles 68. The nozzles 68 are pressurized when each nozzle 68 approaches the gap area 24 during rotation of the roller 10. Consequently, the nozzle 68 sweeps by the electrode-means 16 and then blows away the superfluous particles, which have adhered onto the matrix. By a further rotation of the roller 10, a mechanical cleaning device 69 comprising one or more brushes, pivots into the gap area 24 and mechanically cleans the electrode means. The roller 10 can contain more nozzles 68 and removal devices 69, so that the cleaning procedure is repeated several times, when the roller performs several revolutions. Preferably, the cleaning is performed during the short period when a paper sheet is fed out from the area and a new paper is fed in.

Preferably, the brushes 69 are formed of an electrically conducting material, for example, carbon fiber. The brushes are preferably galvanically connected to the roller 10, which, via a sliding contact 71, is intermittently connected to a control device 72. For example, between the output and input of a paper sheet in the particle carrier, a switch in a ground connection 73 is activated to drain the electrostatic charge on the electrode means.

Figure 18:
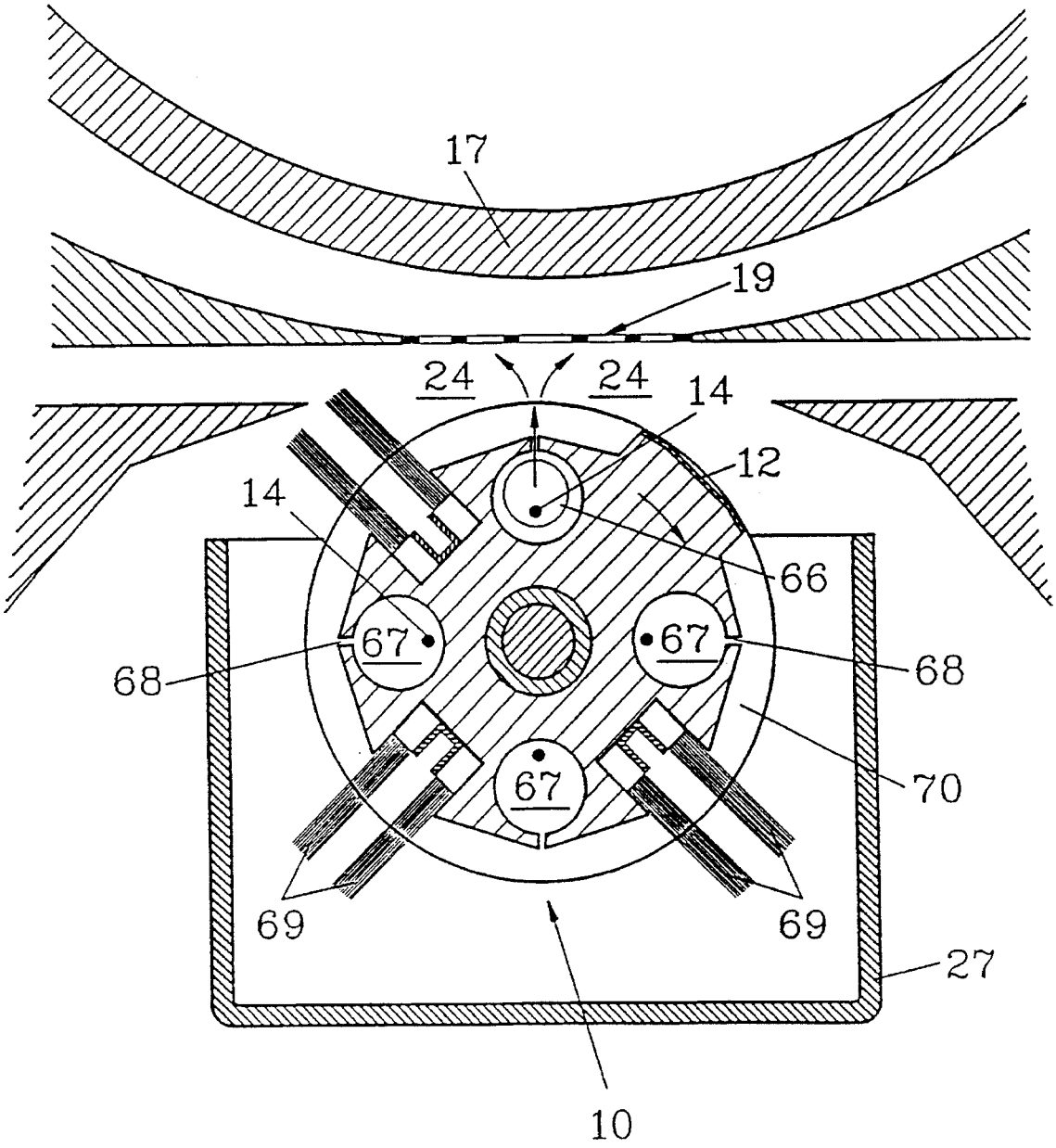
FIG. 18 is a cross-section view of yet another embodiment of the present invention.

The embodiment according to FIG. 18 differs from the one shown in FIG. 17, in that the compressed air is supplied to the roller 10 via a stationary gable 70, in which the feeder 66 connected to a compressed air source is arranged. The roller 10 and the gable 70 are located in a vessel 27, which together form a station, where the mechanical cleaning device leaves the particles removed from the electrode means.

The invention is not limited to the above described embodiments, and can be modified within the scope of claims. Consequently, it is conceivable to combine characteristics of an embodiment with characteristics of one or more embodiments.

We claim:

1. A method for improving printing quality in an electrographic printer having an electrode device for generating a latent electric charge pattern from electric signals, the electrode device being arranged within a gap area between a toner particle carrier and a back electrode of the printer, the latent electrical charge pattern of the electrode device being located and operable to attract toner particles from the toner particle carrier toward the back electrode, the method comprising the steps of:

generating at least two separate airflows;

charging the airflows with a plurality of charged ions; and directing the airflows containing the charged ions by propelling the at least two separate airflows toward the gap area and each other and into the gap area so that the at least two separate airflows meet in the gap area and so that the charged ions neutralize electrostatic attraction forces between the toner particles and between the toner particles and the electrode device to remove toner particles located on the electrode device wherein portions of each of the at least two airflows deflect against the electrode device and remaining portions of each of the at least two airflows move through the electrode device.

2. The method according to claim 1, wherein the step of generating an airflow includes the step of generating one of a blowing airflow and a sucking airflow.

3. The method according to claim 1, further comprising the step of mechanically cleaning the electrode device by cleaning a surface of the electrode device.

4. The method according to claim 1, wherein the step of directing the airflow through the gap area occurs when no toner particles are being attracted from the toner particle supply toward the back electrode.

5. The method according to claim 1, wherein the charged ions are positively charged.

6. The method according to claim 1, wherein the charged ions are negatively charged.

7. The method of claim 1, wherein the electrode device comprises only one electrode layer and an electrostatic field is generated directly between the back electrode and the toner particle carrier to attract the toner particles from the toner particle carrier toward the back electrode.

8. A device to improve printing quality in an electrographic printer having an electrode unit for generating a latent electric charge pattern from electric signals, the electrode unit being arranged within a gap area located between a toner particle carrier and a back electrode of the printer, the latent electrical charge pattern of the electrode unit being located and operable to attract toner particles from the toner particle carrier toward the back electrode, the device comprising:

at least one ion generator arranged for generating an airflow containing a plurality of charged ions;

at least one distribution member arranged for distributing the airflow containing the charged ions into the gap area;

at least one magnet located to one of attract and repel toner particles adhered on the electrode unit.

9. The device according to claim 8, wherein the at least one magnet has a north and a south pole and a pole shoe is arranged on each of the north pole and the south pole, each pole shoe having a free end which extends beyond an end surface of the magnet so as to generate a magnetic field to attract the toner particles stuck on the electrode unit.

10. The device according to claim 8, further comprising at least one attraction pole located in front of the magnet on one side of the electrode unit so as to direct the magnet field.

11. The device according to claim 8, wherein the electrode unit comprises horizontally and longitudinally extending electrodes.

12. The device according to claim 8, wherein the electrode unit comprises a dielectric conveyer with pervasive apertures being surrounded by electrodes.

13. The device according to claim 8, wherein the electrode unit comprises an insulating conveyer having apertures, each of the apertures being surrounded by conducting material.

14. The device of claim 8, wherein the electrode unit comprises only one electrode layer and an electrostatic field is generated directly between the back electrode and the toner particle carrier to attract the toner particles from the toner particle carrier toward the back electrode.

15. The device according to claim 8, wherein the ion generator comprises a first conductor, a second conductor and a voltage supply connected to at least one of said first conductor and said second conductor to produce a potential difference between said first and second conductors.

16. A device to improve printing quality in an electrographic printer having an electrode unit for generating a latent electric charge pattern from electric signals, the electrode unit being arranged within a gap area located between a toner particle carrier and a back electrode of the printer, the latent electrical charge pattern of the electrode unit being located and operable to attract toner particles from the toner particle carrier toward the back electrode, the device comprising:

at least one ion generator arranged for generating an airflow containing a plurality of charged ions;

at least one distribution member arranged for distributing the airflow containing the charged ions into the gap area;

a carrier member, wherein the back electrode, the at least one ion generator and at least one magnet is arranged on the carrier member, the carrier member being movable to position each of the back electrode, the at least one ion generator and the at least one magnet at a location opposite to the electrode unit.

17. The device according to claim 16, further comprising a cleaning blade arranged for removal of toner particles adhered on the carrier member.

18. The device according to claim 16, wherein the carrier member includes a cylindrical hull, the device further comprising a toner waste container removably arranged in the cylindrical hull and the at least one magnet is arranged outside of the hull in a recess having an opening communicating with an interior of the hull (11), the at least one magnet being rotatable about its center axis and a center axis of the hull, and a cleaning blade arranged in contact with the at least one magnet located at said opening so that the toner scraped from the magnet is delivered into said waste toner container through said opening.

19. The device according to claim 18, wherein the back electrode is spring-loaded and removably mounted in the hull.

20. The device according to claim 16, further comprising a partially circular outer hull, an inner hull and a scorotron arranged in the inner hull, and the back electrode and the at least one magnet is arranged in the partially circular outer hull, which is rotatable about its center axis, the outer hull having chamfers at the end portions thereof.

21. The device according to claim 20, wherein the scorotron and the corona wire are movable toward and away from the electrode unit.

22. The device according to claim 16, further comprising a device for one of rotating the carrier member and laterally displacing the carrier member relative to the back electrode.

23. A device to improve printing quality in an electrographic printer having an electrode unit for generating a latent electric charge pattern from electric signals, the electrode unit being arranged within a gap area located between a toner particle carrier and a back electrode of the printer, the latent electrical charge pattern of the electrode unit being located and operable to attract toner particles from the toner particle carrier toward the back electrode, the device comprising:

at least one ion generator arranged for generating an airflow containing a plurality of charged ions;

at least one distribution member arranged for distributing the airflow containing the charged ions into the gap area; the at least one distribution member includes at least one air compressor, and the at least one ion generator is arranged within the air compressor.

24. The device according to claim 23, further comprising at least one nozzle extending along substantially an entire length of the electrode unit, and a guide arranged to temporarily deflect and sweep, respectively, the airflow at least against the electrode unit to thereby create an overpressure in the gap area.

25. The device according to claim 24, wherein the at least one distribution member comprises a plurality of nozzles arranged to discharge the airflow into the gap area on at least two sides of the back electrode, the nozzles being arranged to cooperate with a plurality of valves having flaps so that when the flaps are in a non-compressed state, the flaps bear on openings of the nozzles and when the flaps are in a compressed state, the flaps revolve into the gap area by means of compressed air discharged through the nozzles.

26. The device according to claim 23, wherein a part of the compressor and the back electrode are arranged to form a boundary of the gap.

27. The device according to claim 23, further comprising a movement mechanism for moving the compressor, wherein the compressor includes an expansion device including one of a bellows, a plunger and a membrane, the expansion device being connected to the compressor so as to form a container, the movement mechanism of the compressor being located in the container.

28. The device according to claim 27, wherein the movement mechanism comprises a socket, a rotatable screw cooperating with the socket and a coupling, the coupling being located for engaging and disengaging between the screw and the socket.

29. The device according to claim 25, further comprising a holding member for supporting the electrode unit, the holding member having contact surfaces arranged to cooperate with free end portions of the flaps of the valve.

30. The device according to claim 23, further comprising a plurality of nozzles arranged along two opposite sides of the electrode unit and directed into the gap area at respective angles such that air streams emitted from the nozzles are deflected against the electrode unit and against the back electrode.

31. The device according to claim 23, further comprising at least one nozzle arranged at one side of the electrode unit and a stop member forming a nonreturnable valve at an opposite side of the electrode unit, the stop member being formed to close a boundary of the gap area when an airflow is present within the gap area and to allow passage of an information carrier when the airflow is not present in the gap area.

32. The device according to claim 23, further comprising a mechanical cleaning device located in the gap area for cleaning the electrode unit, the cleaning device being located so as to be intermittently connectable to a ground connection.

33. The device according to claim 32, further comprising a carrier member, wherein the back electrode, a plurality of nozzles and the mechanical cleaning device are arranged on the carrier member, the carrier member being movable to locate the back electrode, the plurality of nozzles and the cleaning device at a position in the gap area.

34. The device according to claim 33, wherein the cleaning device is movable to a passive position so as to pass a station for delivery of toner particles which particles are removed from the electrode device while the cleaning device is in an active position.

35. A device to improve printing quality in an electrographic printer having an electrode unit for generating a latent electric charge pattern from electric signals, the electrode unit being arranged within a gap area located between a toner particle carrier and a back electrode of the printer, the latent electrical charge pattern of the electrode unit being located and operable to attract toner particles from the toner particle carrier toward the back electrode, the device comprising:

at least one ion generator arranged for generating an airflow containing a plurality of charged ions;

at least one distribution member arranged for distributing the airflow containing the charged ions into the gap area;

a carrier member and a toner waste container, wherein the ion generator, the toner waste container, at least one magnet and the back electrode are arranged separately on the carrier, the carrier being movable so as to move the ion generator, the toner waste container, the at least one magnet and the back electrode at a position opposite to the electrode unit.

36. The device according to claim 35, further comprising a cylindrical hull, wherein the at least one magnet is arranged within the cylindrical hull.

37. The device according to claim 35, further comprising a scorotron and a cleaning blade, the at least one magnet being arranged adjacent to the scorotron and the cleaning blade being arranged to clean the at least one magnet.

38. The device according to claim 35, wherein the ion generator is stationary and comprises a corona needle directed towards a grid.

* * * * *